United States Patent [19]

Kanbe et al.

[11] Patent Number: 4,511,239

[45] Date of Patent: Apr. 16, 1985

[54] DEVELOPING DEVICE

[75] Inventors: Junichiro Kanbe, Tokyo; Nagao Hosono, Chofu, both of Japan

[73] Assignee: Canon Kabushiki Kaisha, Tokyo, Japan

[21] Appl. No.: 645,530

[22] Filed: Aug. 29, 1984

Related U.S. Application Data

[63] Continuation of Ser. No. 594,961, Apr. 2, 1984, abandoned, which is a continuation of Ser. No. 452,289, Dec. 22, 1982, abandoned, which is a continuation of Ser. No. 114,216, Jan. 22, 1980, abandoned.

[30] Foreign Application Priority Data

Feb. 2, 1979 [JP] Japan ..... 54-11662
Feb. 2, 1979 [JP] Japan ..... 54-11663
Feb. 2, 1979 [JP] Japan ..... 54-11664

[51] Int. Cl.[3] ..... G03G 15/09
[52] U.S. Cl. ..... 355/3 DD; 118/657; 118/658
[58] Field of Search ..... 355/3 R, 3 DD; 118/653, 118/656, 657, 658, 661

[56] References Cited

U.S. PATENT DOCUMENTS

| | | | |
|---|---|---|---|
| 4,081,571 | 3/1978 | Nishihama et al. | 355/3 DD X |
| 4,119,060 | 10/1978 | Mochizuki et al. | 118/653 |
| 4,126,100 | 11/1978 | Nishihama et al. | 118/658 |
| 4,233,935 | 11/1980 | Uehara et al. | 118/657 |
| 4,244,322 | 1/1981 | Nomura et al. | 118/657 X |
| 4,254,202 | 3/1981 | Matsumoto et al. | 118/653 X |
| 4,292,387 | 9/1981 | Kanbe et al. | 355/3 DD X |
| 4,386,577 | 6/1983 | Hosono et al. | 118/657 |
| 4,387,664 | 6/1983 | Hosono et al. | 118/658 |
| 4,391,512 | 7/1983 | Nakamura et al. | 355/3 DD |

*Primary Examiner*—Fred L. Braun
*Attorney, Agent, or Firm*—Fitzpatrick, Cella, Harper & Scinto

[57] ABSTRACT

A developing device including a magnet, a non-magnetic sleeve for supporting magnetic developer and a magnetic blade for forming a layer of magnetic developer on the surface of the sleeve in successive order and in mutually separated manner. Assuming the half-peak width of the principal pole of said magnet is 2l, the relative position $\theta$ of the magnetic blade with respect to the center line of the magnetic pole is selected within a range $\theta \leqq l$ in the moving direction of the sleeve and within a smaller range in the opposite direction. Further, the relative position $\theta$ is rendered adjustable in order to regulate the developing density.

10 Claims, 13 Drawing Figures

DEVELOPING DEVICE

This application is a continuation of application Ser. No. 594,961 filed Apr. 2, 1984, now abandoned, which is a continuation of U.S. Ser. No. 452,289 filed Dec. 22, 1982, now abandoned, which is a continuation of original application U.S. Ser. No. 114,216, filed Jan. 22, 1980, now abandoned.

BACKGROUND OF THE INVENTION

1. Field of the Invention

The present invention relates to a developing device, and more particularly to a developing device for rendering an electrostatic latent image visible with a one component magnetic developer.

2. Description of the Prior Art

The conventional dry developing processes for developing an electrostatic pattern are classified, with respect to the developer composition, into two-component development and one-component development. The former employs a developer composed of a mixture of carrier particles such as iron powder or glass beads and toner particles for developing the electrostatic pattern, and is associated with the drawbacks of the fluctuation of developing density resulting from the change in the mixing ratio of the carrier particles and the toner particles, and the deterioration of image quality resulting from the deterioration of the carrier particles.

On the other hand, the latter one-component development is free from the above-mentioned drawbacks due to the absence of the carrier particles, and is therefore expected to be used more widely in the future. The known one-component developer consists of toner particles incorporating magnetic powder therein for the purpose of causing frictional charge by relative movement of toner particles or transporting the toner particles to a development area facing the electrostatic image to be developed.

However the content of said magnetic powder in the toner particles is inevitably limited as the toner particles have to be bindable either by heat or by pressure to the transfer sheet in order to fix the toner image. In practice said magnetic powder constitutes 10 to 60 wt.% of the toner particles, but the volume content of said magnetic powder in the toner particles is only 20% or less because of the difference in the specific gravity of the magnetic powder and other resin components. Due to such low volume content of the magnetic powder, the toner particles show a behavior in a magnetic field different from that of the magnetic powder itself, and it becomes difficult to obtain a long low-density magnetic brush at the position of the magnetic pole. For this reason the toner layer formed on the toner supporting member, when limited to a thickness of several millimeters, tends to form an uneven distribution.

Said unevenness in the toner layer on the support member tends to be reproduced in the developed image, and the dense toner layer present on the support member except at the position of the magnetic pole may cause coagulation of toner particles or damage to the photoconductor holding the electrostatic image when said layer is pressed against the surface of said photoconductor if said layer has fluctuations in thickness. For this reason it is essential, in the development with a one-component magnetic toner, to form a thin uniform layer of toner particles on the toner supporting member.

In general, in case a thickness defining member is positioned close to the surface of the supporting member to form a slit therewith for defining the thickness of a powder layer on said supporting member when it is displaced with respect to said thickness defining member, the actually obtained thickness defined by said slit becomes slightly larger than the gap of said slit.

Because of this fact, in the development with one-component magnetic toner, it has been required, in the use of a conventional non-magnetic thickness defining member for forming a thin toner layer, to position said member very close to the toner supporting member, thereby requiring an elevated mechanical precision. Also the slit may be clogged with toner particles coagulated by various causes to hinder the tone layer formation in such clogged portion.

The use of a levelling roller for defining the thickness of one-component toner is disclosed for example in the U.S. Pat. No. 4,100,884. Also the use of an ordinary non-magnetic doctor blade for levelling the one-component magnetic toner supported on a sleeve and transported magnetically thereon by a magnet roll rotated in said sleeve is disclosed in the U.S. Pat. No. 4,014,291. However such known methods are limited to the non-magnetic levelling or doctoring means, and do not cover the use of magnetic doctoring means, principally because of the following reason.

In the conventional magnetic brush development, two-component developer or one-component developer is applied to a non-magnetic cylinder embracing a magnet. A non-magnetic doctor blade, or the like, is disposed in spaced relation with the cylinder surface to level the developer to a desired height above the cylinder surface. A non-magnetic blade is commonly used since it can provide the magnetic brush with a uniform height.

If the non-magnetic blade of such conventional device is merely replaced with a magnetic one, the magnetic field between the blade and the magnet behind the cylinder causes the brush to extend toward the blade. The extended brush will be torn by the rotation of the cylinder, thus resulting in an uneven height of the brush and leading to an undesirable development. On the other hand, in the case where what is desired is a much thinner developer layer than in the conventional development in which the magnetic brush thickness is usually in excess of 5 mm, a magnetic doctoring member is found to be effective for reducing the developer layer to a thickness for example of 0.03–0.3 mm, wherein said thin layer is maintained in facing relationship to the image bearing member with a clearance for example of 0.05–0.5 mm thereto. In such a thin layer, the eventual unevenness in the thickness caused by the use of a magnetic doctoring member is negligible because the layer thickness itself is already very small.

A method for forming, in a magnetic field, a thin and uniform layer of one-component toner on the surface of a cylinder is disclosed in the present assignee's co-pending U.S. patent application Ser. No. 938,494, filed Aug. 31, 1978 now abandoned in favor of application Ser. No. 267,771, which continuation has issued as U.S. Pat. No. 4,386,577 and a division of U.S. Pat. No. 4,386,577 has issued as U.S. Pat. No. 4,387,664.

SUMMARY OF THE INVENTION

The present invention is to eliminate the above-mentioned drawbacks of the conventional developing devices utilizing one-component magnetic toner and to further improve the invention of the above-mentioned co-pending application for the following objects, and the principal object of the present invention is to provide a developing device capable of forming, on a developer supporting member, an extremely uniform developer layer of a desired thickness.

Another principal object of the present invention is to provide a developing device capable of controlling the thickness of the developer layer, thereby easily adjusting the developing density.

The features of the present invention are exemplified by:

a developing device comprising a magnet 1, non-magnetic supporting means 3 for supporting magnetic developer 5 thereon and a magnetic member 4 for forming a layer of said magnetic developer on said supporting means, wherein said magnet, supporting means and magnetic member are arranged in successive order and in mutually separated manner and the relative position $\theta$ of said magnetic member with respect to the center line of the principal pole 2 of said magnet having a half-peak width of 2l is selected within a range $\theta \leqq l$ in the moving direction of said developer supporting means and within a smaller range in the opposite direction:

a developing device wherein said supporting means is a rotary sleeve embracing said magnet therein, and said magnetic member is positioned within a range $\theta \leqq l$ in the rotating direction of said sleeve and in a range $\theta \leqq 15°$ in the opposite direction;

a developing device comprising non-magnetic developer-supporting means displaced in facing relation to a fixed magnet, a container for supplying magnetic toner, and a magnetic applying member for applying said magnetic toner onto said supporting means, wherein the front end of said applying member is positioned between the center of the width of the principal pole of said fixed magnet and an end of said pole in the moving direction of said developer-supporting means and in a spaced relation to the surface thereof;

a developing device wherein the angle between the front end of said applying member and the center line of said principal pole is not in excess of 30°;

a developing device wherein said magnetic toner is electrically insulating and is adapted to be charged by friction with said developer-supporting means;

a developing device comprising non-magnetic developer-supporting means displaced in facing relation to a magnet, means for supplying magnetic developer, a magnetic member positioned at the principal pole of said magnet and in spaced relation to the surface of said developer-supporting means and adapted for defining by magnetic force the application of said magnetic developer onto the surface of said developer-supporting member, and means for regulating the relative position of said magnetic member with respect to said principal pole within a range of the magnetic field of said magnet thereby adjusting the developing density;

a developing device wherein the relative position $\theta$ of said magnetic member with respect to the center line of said principal pole having a half-peak width of 2l is rendered adjustable within a range $\theta \leqq l$ in the moving direction of said developer-supporting means and within a groove $\theta \leqq l/2$ in the opposite direction;

a developing device wherein said developer-supporting means is a rotary non-magnetic sleeve embracing a fixed magnet roll, and the relative position $\theta$ of said magnetic member with respect to the center line of the principal pole having a half-peak width of 2l is rendered adjustable within a range $\theta \leqq l$ in the rotating direction of said sleeve and within a range $\theta \leqq 15°$ in the opposite direction; and a developing device wherein said magnet is provided at the developing position with a developing pole wider than said principal pole.

The developing device of the present invention having the structure as explained in the foregoing is capable of regulating the thickness of the developer layer on the developer-supporting means in response to the change in the relative position $\theta$ of said magnetic member with respect to the center line of the principal pole thereby controlling the developing density to be obtained, and it is thus rendered possible to obtain a desirable density suitable for the species, color and shape of the image to be reproduced, and when applied in a copying apparatus utilizing the conventional slit exposure system, to achieve sufficiently detailed density control in combination with the density control by exposure adjustment.

Still other objects and advantages of the present invention will become apparent from the following description to be taken in conjunction with the attached drawings.

DESCRIPTION OF THE PREFERRED EMBODIMENTS

Figure 1:
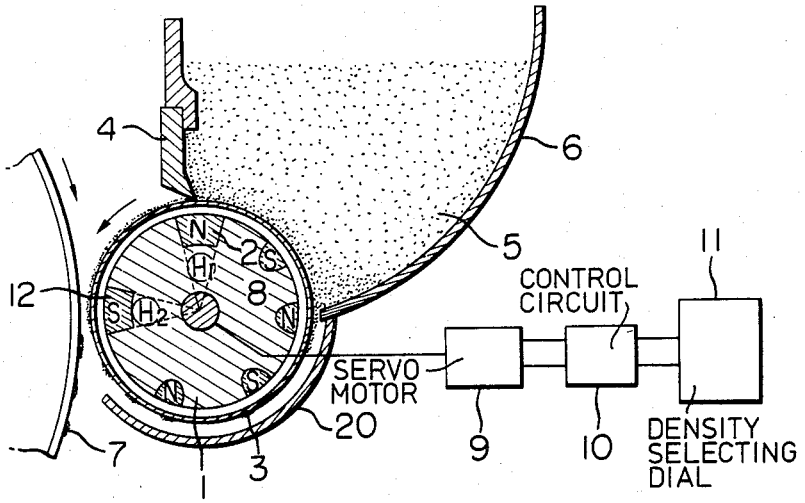
FIG. 1 is a schematic cross-sectional view of an embodiment of the device of the present invention.

In FIG. 1 representing an embodiment of the present invention, there are shown a fixed magnet roll 1 having a main or principal pole 2, which defines a magnetizing force field $H_1$ a non-magnetic sleeve 3 embracing said magnet roll, and a magnetic blade 4 positioned in facing relation to said main pole 2 for applying magnetic insulating toner 5 supplied from a container 6 onto said sleeve 3 with an appropriate thickness along with the rotation of said sleeve 3. It is essential that said magnetic blade is maintained in facing relation to said main pole, whereby the magnetic field therebetween defining the quantity of magnetic toner applied from the container onto the sleeve (see U.S. patent application Ser. No. 938,494, filed Aug. 31, 1978 German Patent Application No. 2839178.8 and British Patent Application No. 35338/78 of the present assignee) to obtain a layer thickness smaller than the gap between said blade and sleeve. Besides said magnetic field functions to suitably break the mass of toner 5, thereby forming an extremely uniform toner layer on the sleeve 3. Said insulating magnetic toner is charged by the friction with the sleeve, during the transportation thereon.

A member 7 bears thereon an electrostatic latent image which is rendered visible by transfer of the toner from the sleeve 3 through a developing gap. The development density generally depends on the thickness of the toner layer on the sleeve and increases if said layer is thicker. Consequently it is possible to arbitrarily select the density if the toner layer thickness on the sleeve is controllable.

In the illustrated embodiment the thickness of the toner layer applied on the sleeve 3 is easily adjustable by changing the relative position of the magnetic blade 4 with respect to the main pole 2 in the following manner.

Figure 2:
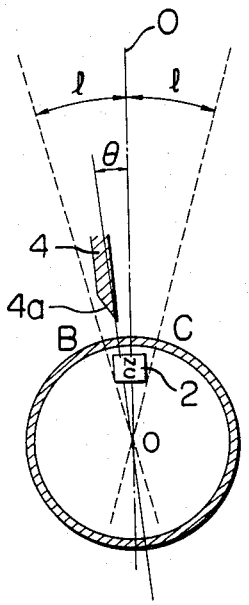
FIG. 2 is an explanatory view showing the positional relation between the half-peak width of the magnetic pole and the magnetic blade.
Figure 3:
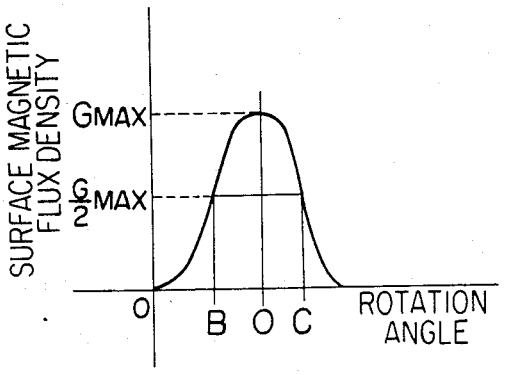
FIG. 3 is a chart showing the relation between the rotation angle and the surface flux density for determining the half-peak width of the pole.

In the following description, the direction along the rotation of sleeve and the direction thereagainst, both with respect to the center line of the main pole 2, are respectively defined as the forward and backward direction, as shown in FIG. 2. At said forward and backward directions there are determined points B and C, as shown in FIG. 3, at which the surface magnetic flux density of the main pole 2 is equal to a half of the maximum flux density $G_{max}$, and the distance of said points B and C is defined as the half-peak width 2l of the pole 2. Further, the angle the front end 4*a* of the magnetic blade 4 forms to the center line O of the pole 2 which extends through the center of magnet roll is defined as the relative position $\theta$.

It is found in the present invention that the toner layer becomes thinner or thicker respectively when said front end 4*a* of the blade 4 is positioned forward or backward with respect to the center line O of the pole 2.

As an example, the main pole 2 has a half-peak width of 30° with a maximum surface flux density of 1100 gauss. The magnetic blade 4 is positioned at a clearance of 150 microns from the sleeve 3. The toner 5 is composed of 70 parts of polystyrene resin, 25 parts of ferrite, 3 parts of carbon black and 2 parts of a charge controlling agent (zapon Fast Black B supplied from BASF), which are further added with 0.2 wt.% of hydrophobic colloidal silica (R-972 supplied from Aerosil Corp.) for improving the fluidity.

The electrostatic image bearing member 7 is maintained at a potential of +500 V in the image areas to be developed, and is spaced from the sleeve 3 by a developing gap of 150 microns, through which the toner particles are transferred from the sleeve 3 to said member 7. 12 is a magnetic pole which defines a magnetizing force field $H_2$ and which is positioned in the developing area. Pole 12 has a flux density of 800 gauss at the sleeve surface.

Figure 4A:
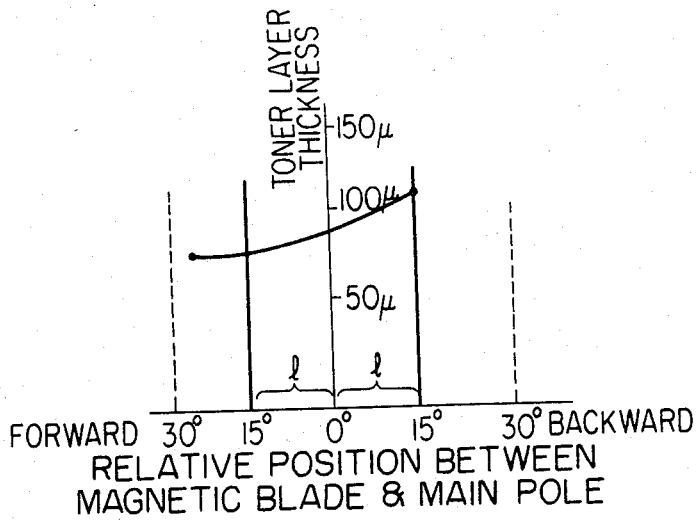
FIGS. 4(A), 4(B), 5(A) and 5(B) are charts showing the relation between the relative position of the magnetic blade to the principal pole and the toner layer thickness or the developing density.

In response to a change in the relative position of the magnetic blade and the main pole caused by the rotation of the magnet roll, the toner layer thickness applied on the sleeve 3 shows a change as indicated in FIG. 4(A) representing the toner layer thickness in microns in the ordinate as a function of the relative position $\theta$ between the magnetic blade and the main pole in the abscissa. The dots on the curve represent the limit points beyond which uniform toner application is unobtainable because of intolerable unevenness in the toner layer.

Figure 4B:
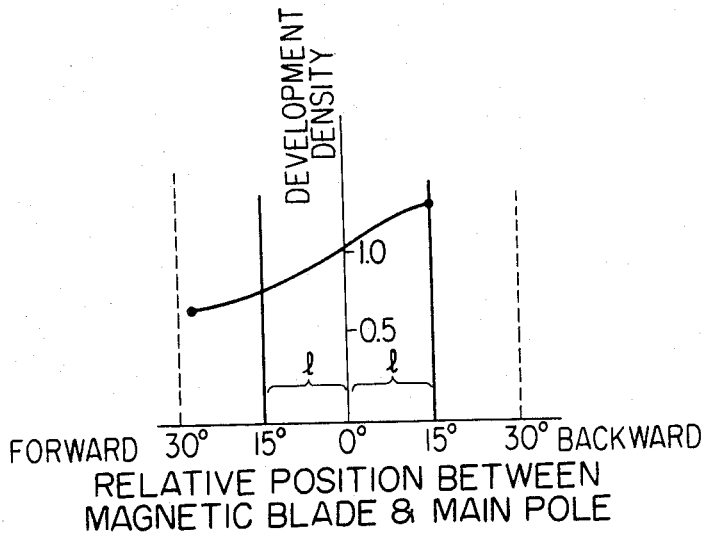

Also FIG. 4(B) shows the development density as a function of said relative position under the above-explained conditions. It will be observed that there exists a strong correlation between the development (reflection) density and the toner layer thickness which can be varied by said relative position.

Figure 5A:
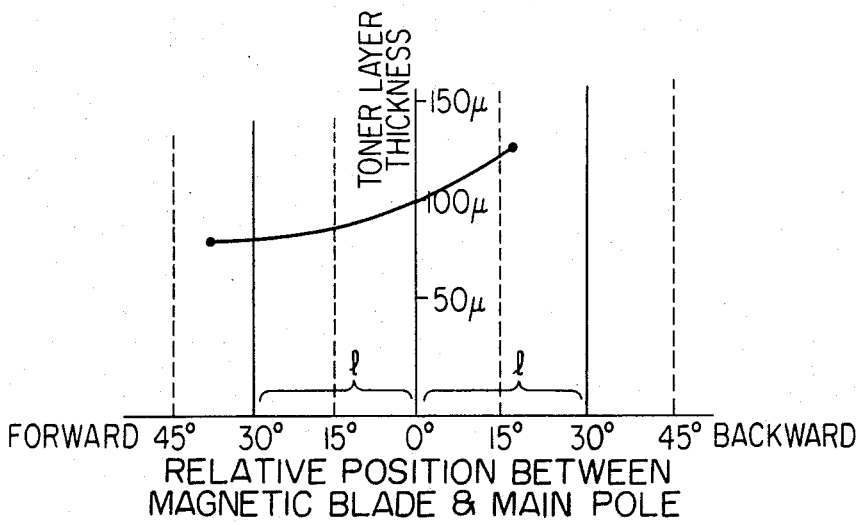
Figure 5B:
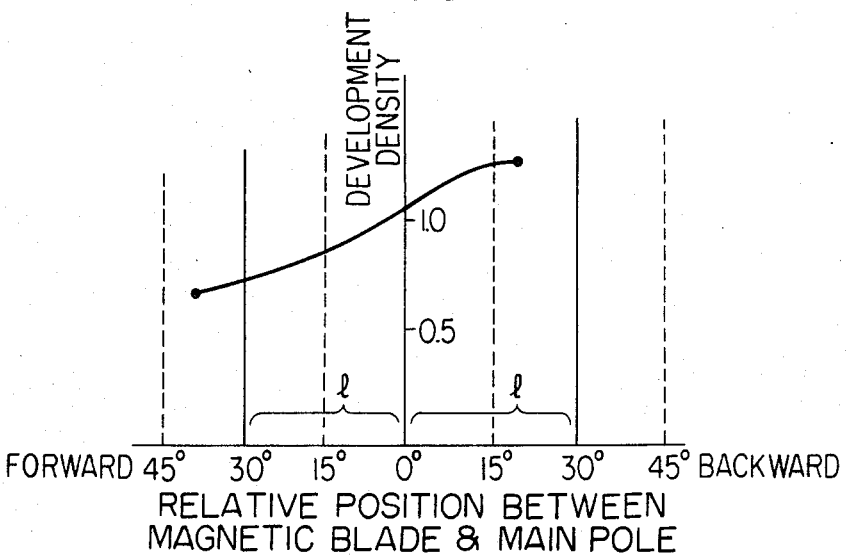

In contrast to FIGS. 4(A) and 4(B) corresponding to a half-peak width of the pole 2 equal to 30°, FIGS. 5(A) and 5(B) show a case of a half-peak width of 60° with a maximum flux density of 750 gauss. The magnetic toner used in this example is obtained by mixing 65 wt.% of styrenemaleic acid resin, 33 wt.% of magnetite and 2 wt.% of a charge controlling agent, followed by crushing and addition of 0.2 wt.% of colloidal silica. It is possible in this example to obtain a thin uniform toner layer by maintaining the magnetic blade at a clearance of 250 microns from the sleeve and reproducing the other conditions the same as already explained.

In the case of FIGS. 4(A) and 4(B) wherein the half peak width is equal to 30°, a substantially uniform thin toner layer can be obtained on the sleeve when the relative position $\theta$ between the magnetic blade and the main pole is within a range of ca. 25° in the forward side or within a range of ca. 15° in the backward side. It is therefore possible to adjust the development density to a desired value by changing said relative position within said ranges.

Also in the case of FIGS. 5(A) and 5(B) wherein the half-peak width is equal to 60°, a substantially uniform thin toner layer can be obtained on the sleeve when the relative position $\theta$ between the magnetic blade and the main pole in within a range of 40° in the forward side or within a range of ca. 20° in the backward side. It is therefore possible to adjust the development density to a desired value by changing said relative position within said ranges.

Figure 6A:
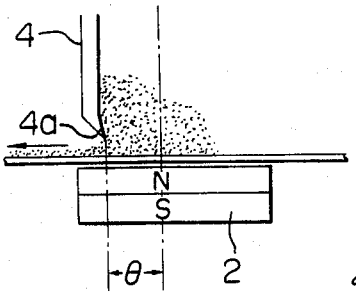
FIGS. 6(A), 6(B) and 6(C) are explanatory views showing the working principle of the present invention.
Figure 6B:
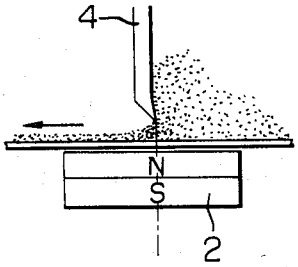
Figure 6C:
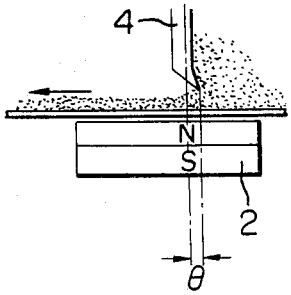

The change in the toner layer thickness caused by the change in said relative position is presumably based on the following reason. Reference is now made to FIG. 6 wherein 6(B), 6(A) and 6(C) respectively represent the cases in which the magnetic blade is positioned at the center, at the forward side or at the backward side of the main pole. In FIG. 6(A) the magnetic field is relatively concentrated at the back side to attract the toner particles backward, whereby the amount of toner passing through the blade opening is limited to provide a thinner toner layer. On the other hand, in FIG. 6(C) the magnetic field is relatively concentrated at the forward side to push the toner particles forward, whereby the amount of toner passing through the blade opening is increased to provide a thicker toner layer.

It is found, as represented in FIGS. 4(A), 4(B), 5(A) and 5(B), that the preferred value of the relative position $\theta$ is for the forward side variable according to the half-peak width 2l of the main pole and most preferably within a range approximately up to a half of said half-peak width, i.e. a range up to l, while said preferred value on the backward side, though not significantly affected by the change in the half-peak width, is within a range up to $\frac{1}{2}$l, or up to ca. 15° in case of a rotary sleeve. In summary the preferred range can be represented by:

$$+l \geqq \theta \geqq -15°$$

or $$+l \geqq \theta \geqq -l/2,$$

wherein the half-peak width is represented by 2l and the relative position of the magnetic blade with respect to the main pole is represented by $\theta$, while the positive and negative signs respectively representing the forward or backward directions with respect to the displacement of the developer-supporting means.

Figure 7:
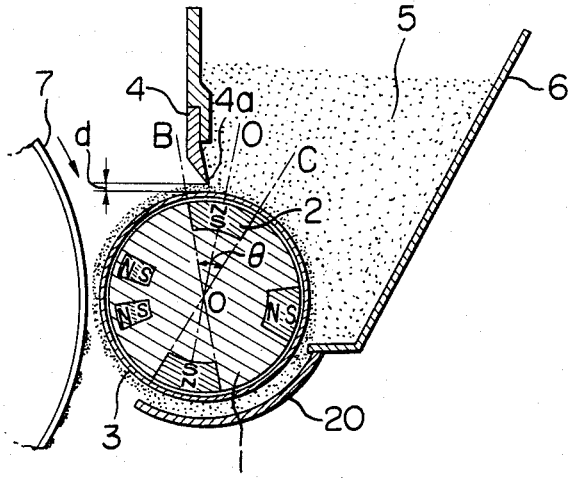
FIG. 7 is a schematic cross-sectional view of another embodiment of the present invention.

FIG. 7 shows another embodiment of the present invention, wherein said relative position $\theta$ is limited within a range of $+1 \geqq \theta > 0$ for further developed purposes. In FIG. 7, the components common with those in FIG. 1 are represented by same numbers and are omitted from the following description. In this embodiment an extremely stable toner layer formation can be achieved by positioning the front end 4*a* of the magnetic blade 4 between the center line O of the main pole 2 and a forward end B thereof in the rotating direction of the sleeve, presumably because of the following reason. When the magnetic blade 4 is positioned between the lines O and B as shown in FIG. 6(A), the magnetic field generated from the front end 4*a* of the blade extends widely backwards, whereby the toner particles present in the vicinity of said front end are subjected to a backward restraining force to retain the toner within the container 6. Consequently there is obtained a thin, stable and extremely uniform toner layer by said magnetic field. The uniform toner layer formation achieved in such arrangement is probably assisted by the fact that the toner mass in the container is broken by the strong magnetic field immediately prior to the toner layer defined by the magnetic blade 4. These effects are experimentally found to be particularly evident when said relative position of the front end 4*a* of the magnetic blade with respect to the center line O of the pole does not exceed 30°.

In the following the present invention will be further clarified by certain examples thereof.

EXAMPLE 1

There is employed a developing device shown in FIG. 7, in which the main pole 2 has a flux density of 1000 gauss at the sleeve surface and the front end 4*a* of an iron blade 4 is positioned at a clearance of 300 microns from the sleeve surface. The front end 4*a* of the magnetic blade 4 is positioned at an angle 10° to the center line O while the point B is positioned at an angle 25° thereto. The insulating magnetic one-component toner 5 is composed of 70 parts of styrene resin, 25 parts of magnetite, 3 parts of a charge controlling agent and 2 parts of carbon black. The toner layer on the sleeve is stably defined to a thickness of ca. 80 microns by rotating the sleeve 2 at a peripheral speed of 100 mm/sec. 20 indicates a casing for preventing dust.

EXAMPLE 2

Figure 8:
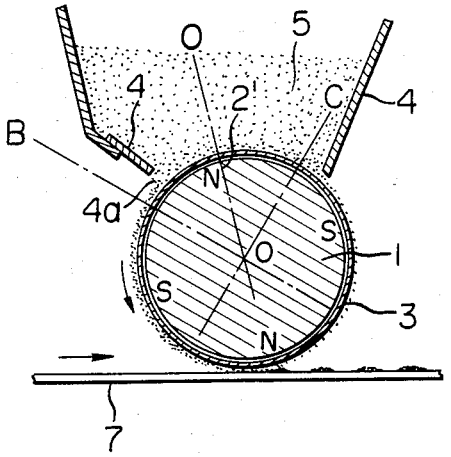
FIG. 8 is a schematic cross-sectional view of still another embodiment of the present invention.

As shown in FIG. 8, there is employed a uniformly magnetized magnet roll 1 having a flux density of 680 gauss caused by the main pole 2' at the surface of the sleeve 3. The front end 4*a* of an iron blade 4 is positioned at a clearance of 150 microns from the sleeve surface, and at an angle of 20° to the center line O. The insulating magnetic one-component toner is composed of 80 parts of polyester resin and 20 parts of black magnetite, further added with 0.5% amount of colloidal silica for improving the fluidity. The toner layer on the sleeve can be stably defined to a thickness of ca. 100 microns by rotating the sleeve 3 at a peripheral speed of 150 mm/sec.

In case of a continuously magnetized roll as shown in FIG. 8, the center line O and the end lines B, C of the main pole 2' are defined, as shown in FIG. 3, respectively at a line connecting the center of said magnet roll and a point corresponding to the maximum $G_{max}$ of the surface flux density curve and at lines connecting said center of magnet roll and points corresponding to a half of said maximum flux density $G_{max}$.

A uniform toner layer can be obtained at any blade position within the aforementioned preferred range of $\theta$, and the development density can be regulated by changing said relative position of the blade within said range.

In the following there will be explained the means for regulating the density. In FIG. 1 there are shown a servo motor 9 connected to the shaft 8 of the permanent magnet 1, a control circuit 10 and a density selecting dial 11, wherein said servo motor 9 is rotated in response to an arbitrary setting of said dial 11 by the operator to modify the relative position of the magnetic blade 4 with respect to the main pole 2. In this manner the sleeve or the magnet can be rotated by known rotating means. The pole 12 in the developing area has a pole width larger than the aforementioned half-peak width of the main pole in order to prevent a significant change of the magnetic field in said developing area in case the magnet roll 1 is rotated as explained above.

Figure 9:
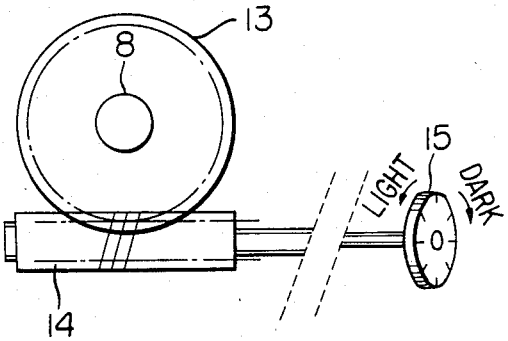
FIG. 9 is a schematic view of an embodiment of the density adjusting means.

FIG. 9 shows another method of rotating the magnet roll, wherein 13 is a worm gear mounted on the shaft of said magnet roll while 14 is a worm gear wheel linked through other gears to a density adjusting dial 15.

As explained in the foregoing, the device of the present invention, being capable of forming a thin uniform layer of magnetic developer on a developer-supporting member member and of defining the thickness of said layer by cutting a magnetically erected curtain with a magnetic member, allows formation of a developer layer thinner than the small clearance between the magnetic member and the developer supporting member. Consequently it is rendered possible to maintain, in the developing gap, a layer thinner than said gap and thus to cause the transfer of developer solely in the image area of the image bearing member thereby providing a visible completely free from background fogging.

Besides the magnetic member can be positioned at any point within the aforementioned range of $\theta$, and it is therefore possible to conduct adjustment so as to maintain a desired thickness or to regulate said thickness according to the relation as shown in FIGS. 4(A), 4(B), 5(A) and 5(B) thereby facilitating the determination of the development density.

The above-mentioned non-magnetic sleeve functions as a support for the developer and also to charge said developer by friction with said sleeve into a polarity opposite to that of the electrostatic latent image, but said charging may be assisted for example by an additional corona discharge. Said sleeve further functions as a developing electrode and for this purpose may be supplied with an AC, DC or mixed bias potential.

The present invention is not only applicable for the development of an electrostatic latent image but also for the development of a magnetic latent image with magnetic toner.

What we claim is:

1. A developing device comprising a movable non-magnetic developer-supporting means having a surface in facing relation to a fixed magnet, means for supplying magnetic developer, a magnetic member positioned at a principal pole of said magnet and in spaced relation to an opposite surface of said developer-supporting means for defining by magnetic force the application of said magnetic developer onto said opposite surface of said developer-supporting means, and means for regulating the relative position of said magnetic member with respect to said principal pole within the range of the magnetic field of said magnet to thereby adjust the development density.

2. A developing device according to claim 1 wherein the relative position $\theta$ of said magnetic member with respect to the center line of said principal pole having a half-peak width of 2l is rendered adjustable within a range $\theta \leqq l$ in the moving direction of said developer-supporting means and within a range $\theta \leqq l/2$ in the opposite direction.

3. A developing device according to claim 1 wherein said developer-supporting means is a rotary non-magnetic sleeve surrounding a fixed magnet roll, and the relative position $\theta$ of said magnetic member with respect to the center line of the principal pole having a half-peak width of 2l of said magnet roll being rendered adjustable within a range $\theta \leqq l$ in the rotating direction of said sleeve and within a range $\theta \leqq 15°$ in the opposite direction.

4. A developing device according to claim 1 wherein said magnet is provided at the developing position with a developing magnetic pole wider than said principal pole.

5. A developing device according to claim 1, wherein said regulating means is means for displacing the magnet.

6. An apparatus for forming a layer of a magnetic developer, comprising:

a rotatable developer carrier;

a fixed magnet having a principal magnetic pole enclosed in said developer carrier;

developer regulating means of a magnetic material having a tip provided in close proximity to a surface of said developer carrier which is remote from said fixed magnet, wherein the tip of said developer regulating means is disposed downstream of said principal pole in the direction of rotation of said developer carrier, and wherein an angular distance $\theta$ between the tip of said developer regulating means and the center of the width of the principal pole and a half-peak width 2l of the principal pole, which is the width where the magnetic flux density is one-half the maximum magnetic flux density provided by the principal pole on the surface of the developer carrier, satisfies the relationship $0 < \theta \leqq l$;

whereby the layer of developer formed on said developer carrier is thinner than that when the tip of said regulating means is placed directly across said developer carrying member from the center of the principal pole of said fixed magnet.

7. An apparatus according to claim 6, wherein the angular distance is less than 30 degrees.

8. An apparatus for forming a layer of a magnetic developer, comprising:

a rotatable developer carrier;

a fixed magnet having a principal magnetic pole enclosed in said developer carrier;

developer regulating means of a magnetic material having a tip provided in close proximity to a surface of the developer carrier which is remote from said fixed magnet, wherein the tip of said developer regulating means is disposed upstream of said principal pole in the direction of movement of said developer carrier, and wherein an angular distance $\theta$ between the tip of said developer regulating means and a center of the width of the principal pole and a half-peak width 2l of the principal pole, which is the width where the magnetic flux density is one-half the maximum magnetic flux density provided by the principal pole on the surface of the developer carrier, satisfies the relationship $0 < \theta \leqq l/2$;

whereby the layer of developer formed on said developer carrier is slightly thicker than that when the tip of said regulating means is placed directly across said developer carrying member from the counter of the principal pole of said fixed magnet.

9. An apparatus according to claim 8, wherein the angular distance $\theta$ satisfies $0 < \theta \leqq 15$ degrees.

10. An apparatus according to claim 6 or 8, wherein the magnetic developer is one-component magnetic, insulating toner particles which are chargeable by the frictional contact with the surface of said developper carrier.

* * * * *

UNITED STATES PATENT AND TRADEMARK OFFICE

CERTIFICATE OF CORRECTION

PATENT NO. : 4,511,239

DATED : April 16, 1985

INVENTOR(S) : JUNICHIRO KANBE, ET AL.

It is certified that error appears in the above-identified patent and that said Letters Patent is hereby corrected as shown below:

Column 2, line 57, after "one-component" insert --magnetic--.

Column 3, line 63, "groove" should read --range--.

Column 6, line 68, "or" should read --and--.

Column 8, line 30, "member member" should read --member--.

Column 10,line 35, "counter" should read --center.

Signed and Sealed this

*Twenty-fifth* Day of *February 1986*

[SEAL]

*Attest:*

DONALD J. QUIGG

*Attesting Officer*

*Commissioner of Patents and Trademarks*